US009860647B2

(12) United States Patent
Wen et al.

(10) Patent No.: US 9,860,647 B2
(45) Date of Patent: Jan. 2, 2018

(54) HIGH SOUND QUALITY PIEZOELECTRIC SPEAKER

(71) Applicant: Transound Electronics Co., Ltd., Dongguan (CN)

(72) Inventors: Tseng-Feng Wen, Dongguan (CN); Huming Zheng, Dongguan (CN); Zhijian He, Dongguan (CN); Xiaolin Deng, Dongguan (CN)

(73) Assignee: TRANSOUND ELECTRONICS CO., LTD., Dongguan, Guangdong (CN)

( * ) Notice: Subject to any disclaimer, the term of this patent is extended or adjusted under 35 U.S.C. 154(b) by 0 days.

(21) Appl. No.: 15/190,202

(22) Filed: Jun. 23, 2016

(65) Prior Publication Data

US 2017/0026758 A1 Jan. 26, 2017

(30) Foreign Application Priority Data

Jul. 22, 2015 (CN) ..... 2015 1 0432594

(51) Int. Cl.

| | |
|---|---|
| ***H04R 25/00*** | (2006.01) |
| ***H04R 17/00*** | (2006.01) |
| ***H04R 9/06*** | (2006.01) |
| ***H04R 1/24*** | (2006.01) |
| *H04R 1/02* | (2006.01) |
| *H04R 7/04* | (2006.01) |

(52) U.S. Cl.

CPC ..... *H04R 17/00* (2013.01); *H04R 1/24* (2013.01); *H04R 9/06* (2013.01); *H04R 1/023* (2013.01); *H04R 7/04* (2013.01)

(58) Field of Classification Search

CPC ..... H04R 1/24; H04R 1/26; H04R 1/023

See application file for complete search history.

(56) References Cited

U.S. PATENT DOCUMENTS

| | | | | |
|---|---|---|---|---|
| 3,943,304 A * | 3/1976 | Piribauer | ..... | H04R 1/24 381/182 |
| 4,418,248 A * | 11/1983 | Mathis | ..... | H04R 1/26 381/190 |
| 7,158,650 B2 * | 1/2007 | Furuya | ..... | H04R 7/22 381/396 |
| 8,948,423 B2 * | 2/2015 | Kim | ..... | H04R 1/24 381/182 |

(Continued)

FOREIGN PATENT DOCUMENTS

| | | | | |
|---|---|---|---|---|
| JP | WO 2016199875 A1 * | 12/2016 | ..... | H04R 1/24 |
| KR | WO 2016104993 A1 * | 6/2016 | ..... | H04R 9/02 |
| KR | WO 2016137200 A1 * | 9/2016 | ..... | H04R 9/02 |

*Primary Examiner* — Curtis Kuntz
*Assistant Examiner* — Ryan Robinson
(74) *Attorney, Agent, or Firm* — Leong C. Lei

(57) ABSTRACT

A high sound quality piezoelectric speaker includes a moving coil speaker, a support frame, a vibration plate, and a piezoelectric ceramic plate. The support frame is arranged on the moving coil speaker and the vibration plate is positioned on the support frame. With the piezoelectric ceramic plate being positioned on the vibration plate, the moving coil speaker and the piezoelectric ceramic plate may collaboratively and better handle both high-frequency and low-frequency sounds, exhibiting relatively wide playback band and making sound quality better, to thereby reach the standard of high sound quality and provide users with improved enjoyment of sound perception.

8 Claims, 23 Drawing Sheets

(56) References Cited

U.S. PATENT DOCUMENTS

| | | | | |
|---|---|---|---|---|
| 9,467,784 | B2 * | 10/2016 | Huang | H04R 1/02 |
| 9,503,805 | B2 * | 11/2016 | Huang | H04R 1/10 |
| 9,532,133 | B2 * | 12/2016 | Huang | H04R 1/1075 |
| 9,654,881 | B2 * | 5/2017 | Ishii | H04R 17/00 |
| 2016/0219373 | A1 * | 7/2016 | Qutub | H04R 1/24 |
| 2016/0277823 | A1 * | 9/2016 | Huang | H04R 1/1016 |

* cited by examiner

HIGH SOUND QUALITY PIEZOELECTRIC SPEAKER

(a) TECHNICAL FIELD OF THE INVENTION

The present invention relates generally to the technical field of speakers, and more particularly to a high sound quality piezoelectric speaker.

(b) DESCRIPTION OF THE PRIOR ART

Moving coil speakers are one of the most commonly used speakers. A conventional moving coil speaker generally comprises a magnetic circuit portion and a vibration portion. The conventional moving coil speaker is structured such that a voice coil is suspended in a magnetic field generated by the magnetic circuit. When an audio frequency current is fed to the voice coil, the voice coil is excited by the magnetic field and thus generates vibration. The voice coil causes a vibration cup to drive air to generate vibration thereby generating sounds.

However, due to factors including physical characteristics of the moving coil speaker itself and resonance of air in the speaker enclosure, the moving coil speaker responds differently to different frequencies of audio signal and has different frequency response curves for high frequency and low frequency and rapid deterioration occurs toward the higher frequencies and lower frequencies. Further, a large speaker is made up of a large vibration membrane, which is generally hard for high speed vibration and thus hard to generate a high frequency sound. Oppositely, a small speaker is generally incapable of driving a large amount of air existing in the speaker enclosure and is thus hard to generate a low frequency sound. In addition, materials and shapes of the coil and the vibration membrane may cause significant segregation of vibration in middle- and high-frequency bands, making it not possible for the speaker to exhibit a wide band of sound reproduction. This is a significant issue in the operation of a speaker. Thus, it is desired to provide improvement over the conventional moving coil speakers.

SUMMARY OF THE INVENTION

In view of this, the present invention is made to overcome the shortcomings of the prior art and the primary object is to provide a high sound quality piezoelectric speaker, which effectively alleviates or overcomes the issue that the conventional moving coil speaker does not exhibit a wide sound playback band.

To achieve the above object, the present invention the present invention adopts the following technical solution:

A high sound quality piezoelectric speaker comprises a moving coil speaker, a support frame, a vibration plate, and a piezoelectric ceramic plate. The support frame is arranged on the moving coil speaker. The vibration plate is arranged on the support frame. The moving coil speaker has a sound emission direction in communication with the vibration plate. The piezoelectric ceramic plate is positioned on the vibration platen.

The present invention shows significant advantages and beneficial effects over the prior art. Specifically, the following can be learned from the technical solution described above:

A support frame can be arranged on an existing moving coil speaker to allow a vibration plate to be positioned on the support frame. With the piezoelectric ceramic plate being positioned on the vibration plate, the moving coil speaker and the piezoelectric ceramic plate may collaboratively and better handle both high-frequency and low-frequency sounds, exhibiting relatively wide playback band and making sound quality better, to thereby reach the standard of high sound quality and provide users with improved enjoyment of sound perception.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
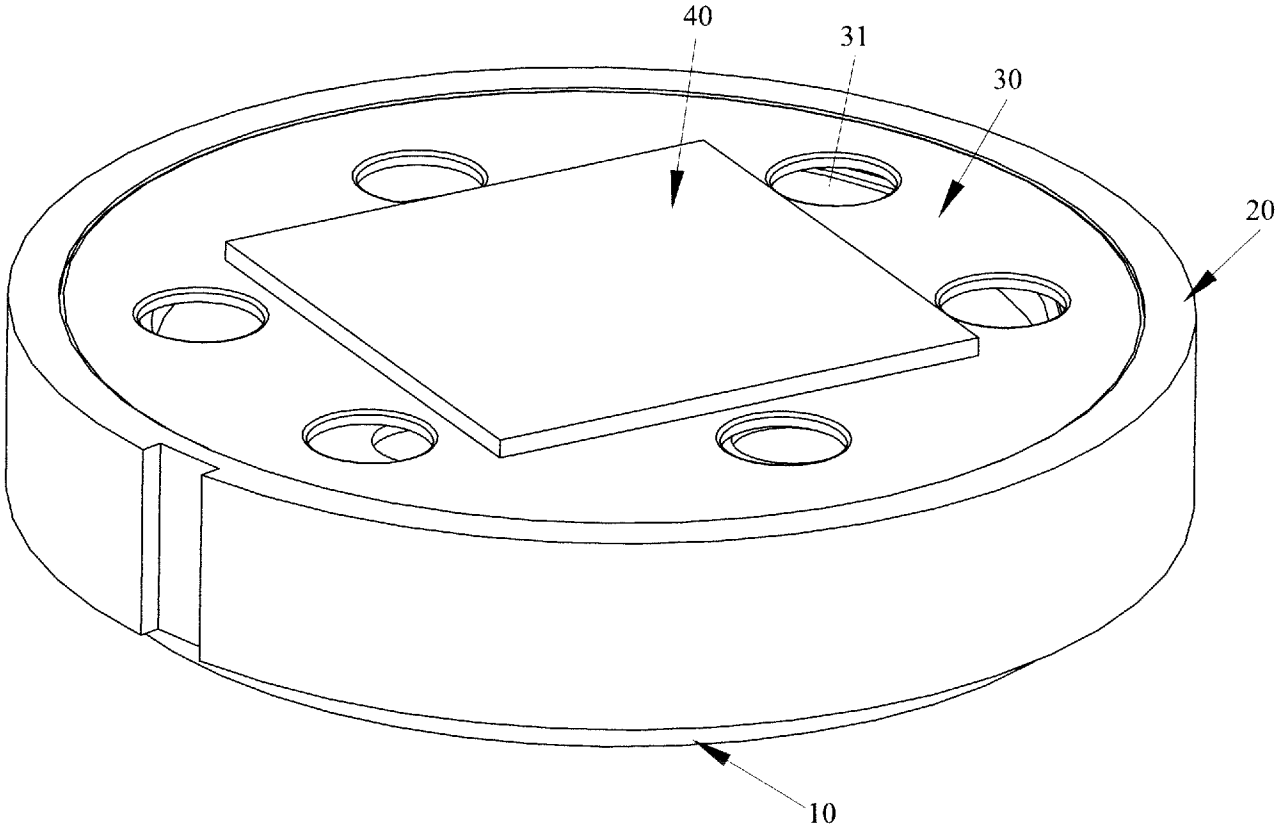
FIG. 1 is a perspective view showing a first preferred embodiment of the present invention in an assembled form.
Figure 2:
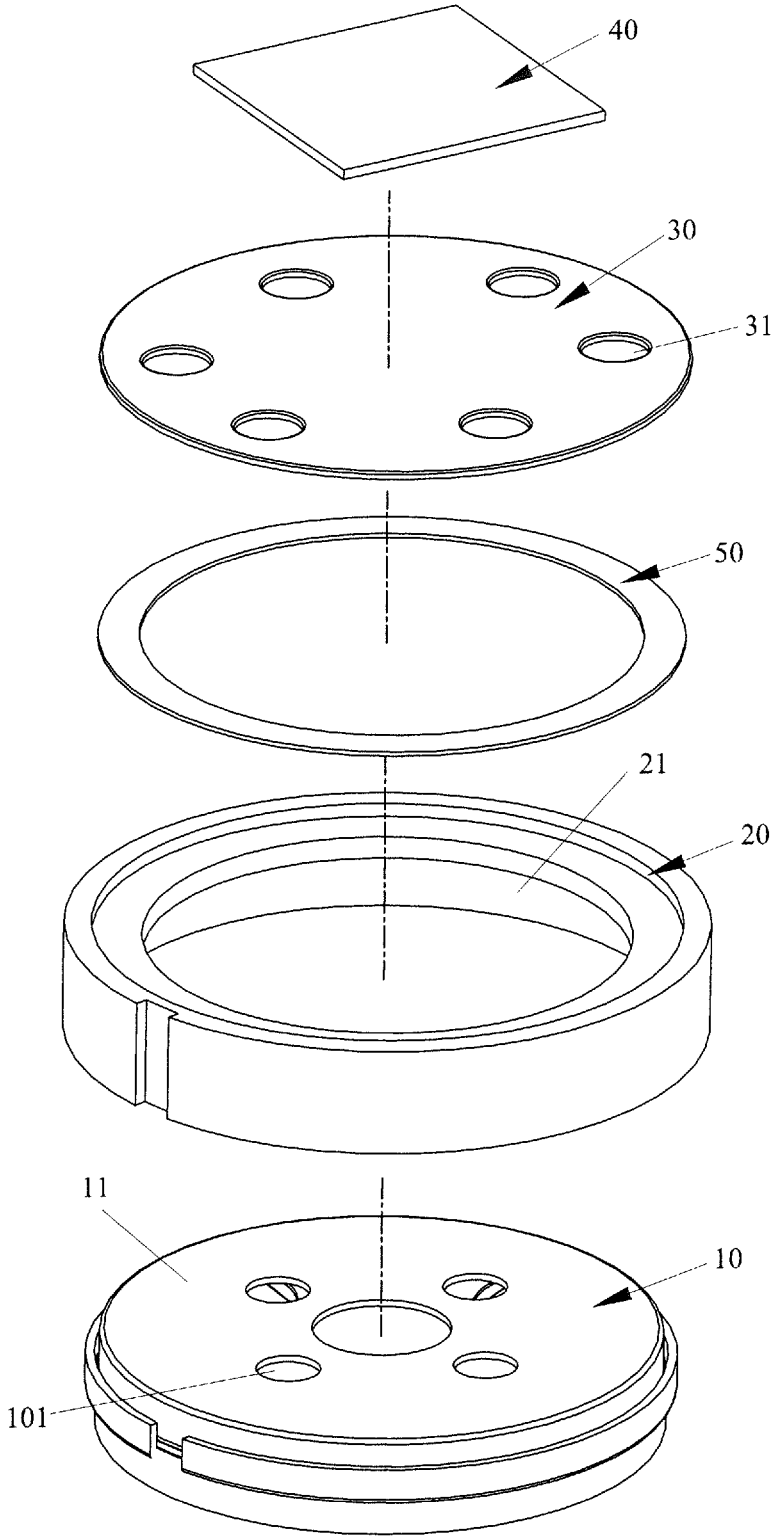
FIG. 2 is an exploded view of the first preferred embodiment of the present invention.
Figure 3:
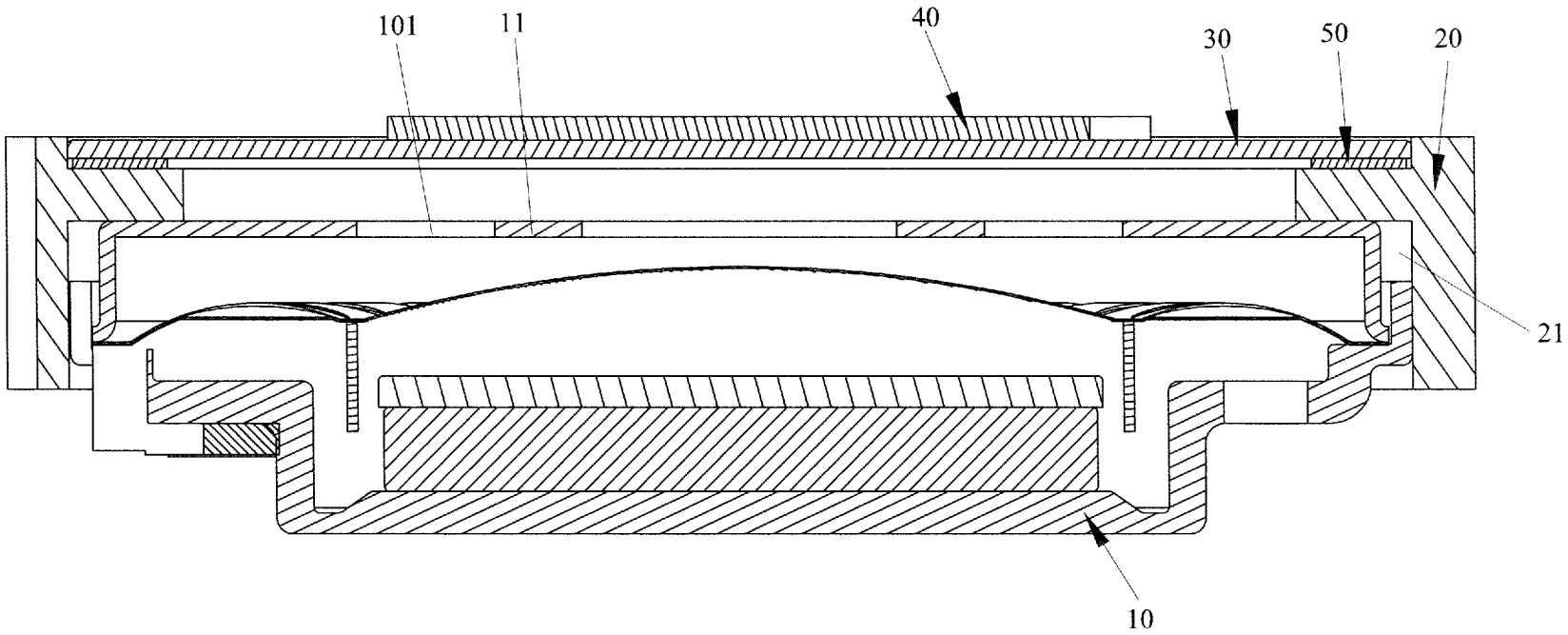
FIG. 3 is a cross-sectional view of the first preferred embodiment of the present invention.

Referring to FIGS. 1-3, a specific structure of a first preferred embodiment of the present invention is illustrated, comprising a moving coil speaker 10, a support frame 20, a vibration plate 30, and a piezoelectric ceramic plate 40.

The support frame 20 is arranged on the moving coil speaker 10. The vibration plate 30 is arranged on the support frame 20. The moving coil speaker 10 defines a sound emission direction communicating with the vibration plate 30. The piezoelectric ceramic plate 40 is arranged on the vibration plate 30. In the instant embodiment, the support frame 20 is an annular frame. The annular frame comprises a receiving compartment 21 formed in one side thereof. The moving coil speaker 10 is received in the receiving compartment 21. The moving coil speaker 10 has a protection cover 11 that comprises a plurality of second sound emission holes 101. The plurality of second sound emission holes 101 is arranged to correspond exactly to the vibration plate 30. The support frame 20 and the vibration plate 30 both have outline contours that are circular. The vibration plate 30 comprises a metallic material. And, the vibration plate 30 and the support frame 20 comprise a first gasket 50 interposed therebetween. The vibration plate 30 comprises a plurality of first sound emission holes 31 formed therein. The plurality of first sound emission holes 31 is arranged to distribute around a periphery of the piezoelectric ceramic plate 40. Further, in the instant embodiment, the piezoelectric ceramic plate 40 is square or rectangular in shape and the piezoelectric ceramic plate 40 is arranged on a surface of the vibration plate 30.

To assemble, first, the moving coil speaker 10 is disposed in the receiving compartment 21, and then, the first gasket 50 and the vibration plate 30 are sequentially disposed on the support frame 20 on the same side thereof and located exactly above and covering the moving coil speaker 10, and afterwards, the piezoelectric ceramic plate 40 is disposed on a surface of the vibration plate 30.

Figure 4:
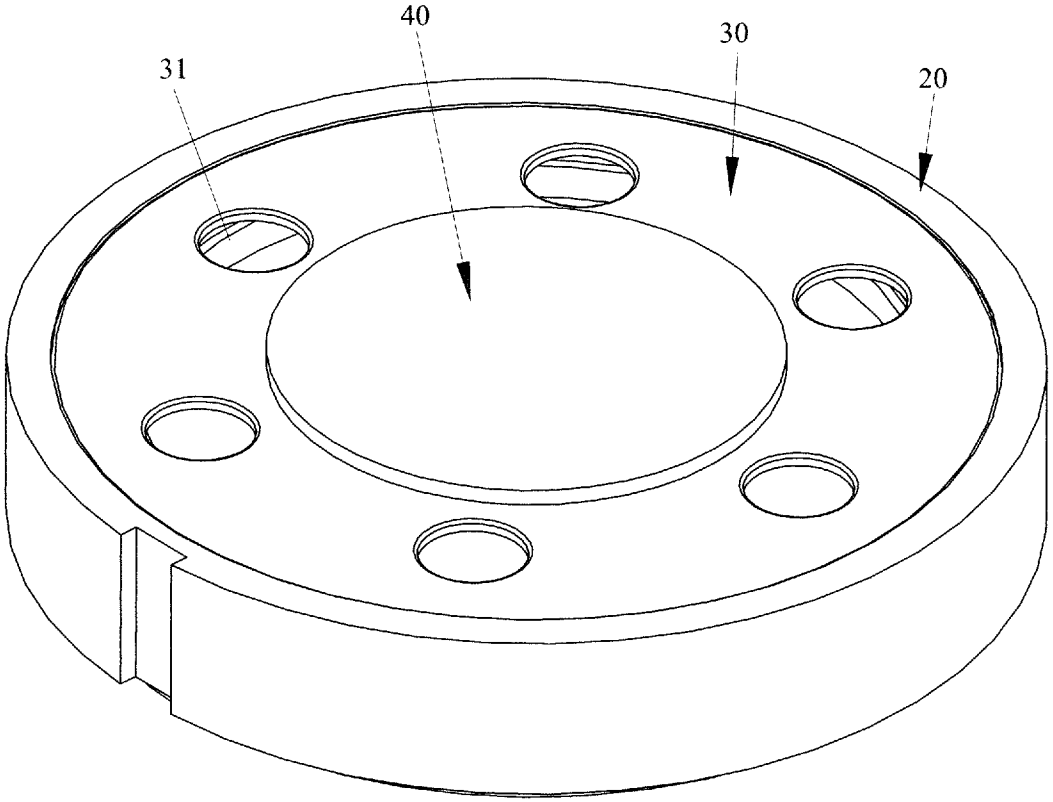
FIG. 4 is a perspective view showing a second preferred embodiment of the present invention in an assembled form.

Referring to FIG. 4, which illustrate a specific structure of a second preferred embodiment of the present invention, the structure of the instant embodiment is generally identical to the structure of the first embodiment and a difference is as follows:

In the instant embodiment, the piezoelectric ceramic plate 40 is circular in shape.

The assembling process of the instant embodiment is generally similar to the assembling process of the first embodiment and thus, no further detail regarding the assembly of the instant embodiment will be provided here.

Figure 5:
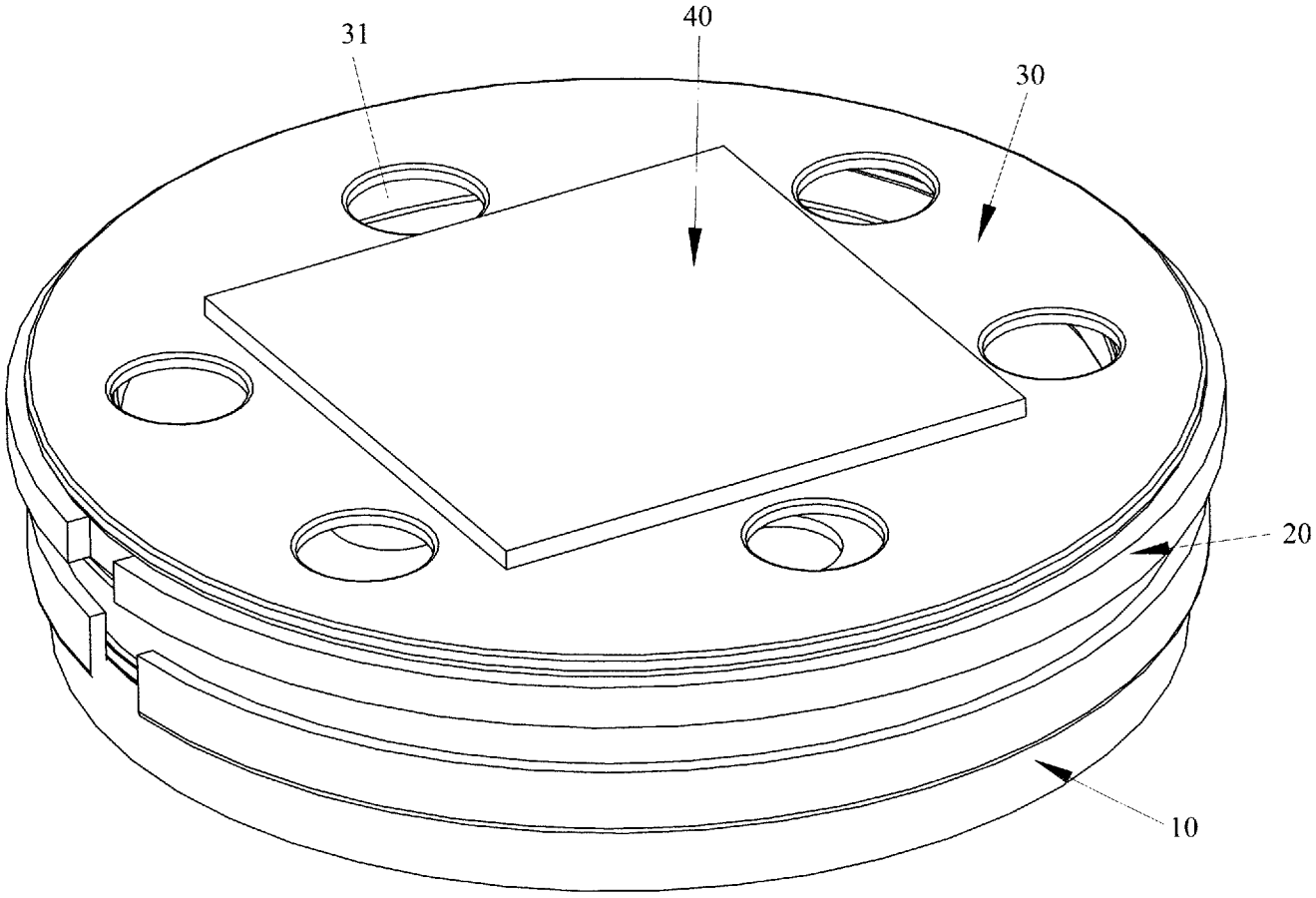
FIG. 5 is a perspective view showing a third preferred embodiment of the present invention in an assembled form.
Figure 6:
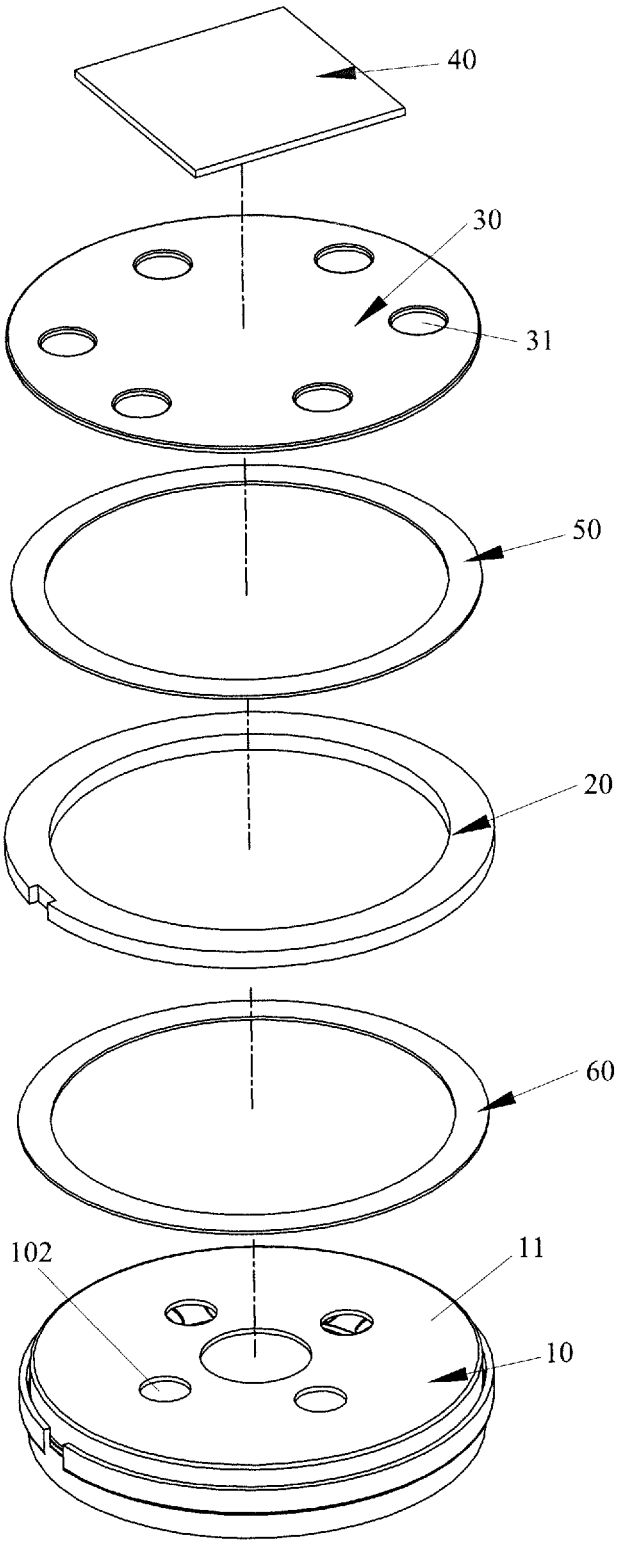
FIG. 6 is an exploded view of the third preferred embodiment of the present invention.
Figure 7:
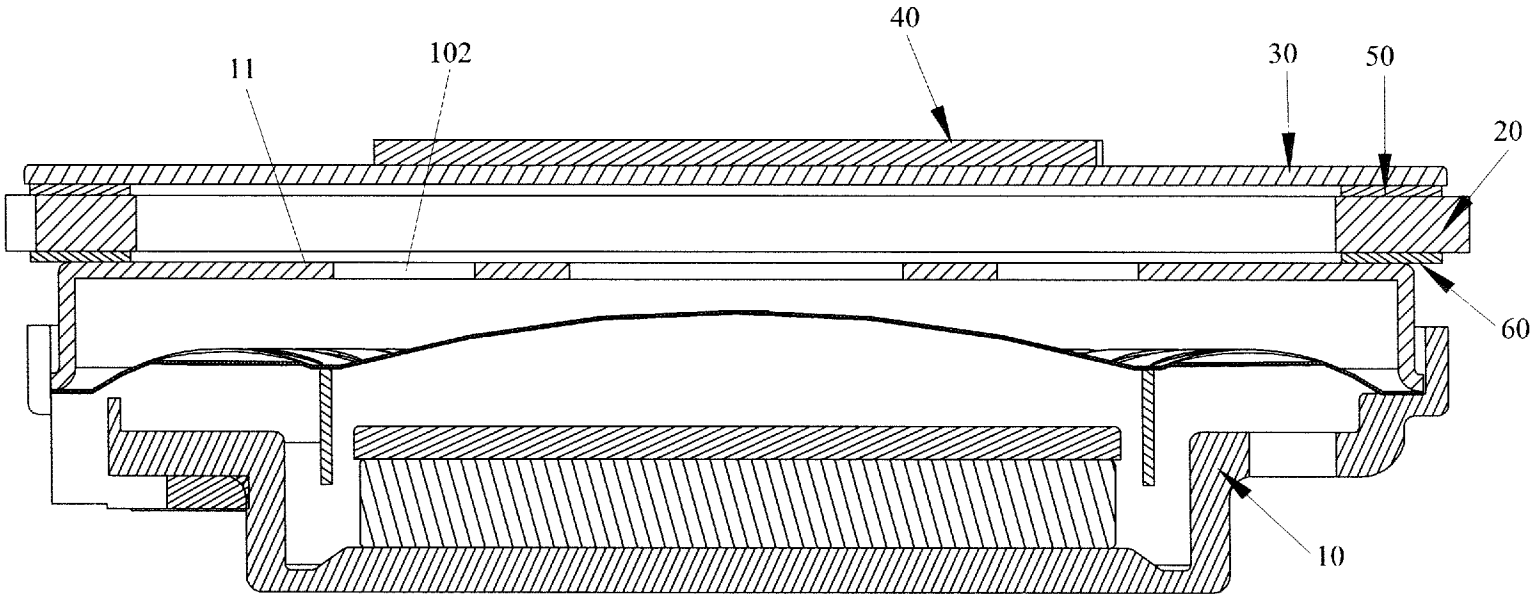
FIG. 7 is a cross-sectional view of the third preferred embodiment of the present invention.

Referring to FIG. 5-7, which illustrate a specific structure of a third preferred embodiment of the present invention, the structure of the instant embodiment is generally identical to the structure of the first embodiment and differences are as follows:

The support frame 20 is a ring-like body. The ring-like body is positioned on the protection cover 11 of the moving coil speaker 10 and the ring-like body and the protection cover 11 comprise a second gasket 60 interposed therebetween. The protection cover 11 comprises a plurality of third sound emission holes 102 formed therein and the plurality of third sound emission holes 102 is arranged to correspond exactly to the vibration plate 30.

To assemble, the second gasket 60 and the support frame 20 are sequentially disposed on the protection cover 11 of the moving coil speaker 10, and then, the first gasket 50 and the vibration plate 30 are sequentially disposed on the support frame 20 the moving coil speaker 10, and afterwards, the piezoelectric ceramic plate 40 is positioned on a surface of the vibration plate 30.

Figure 8:
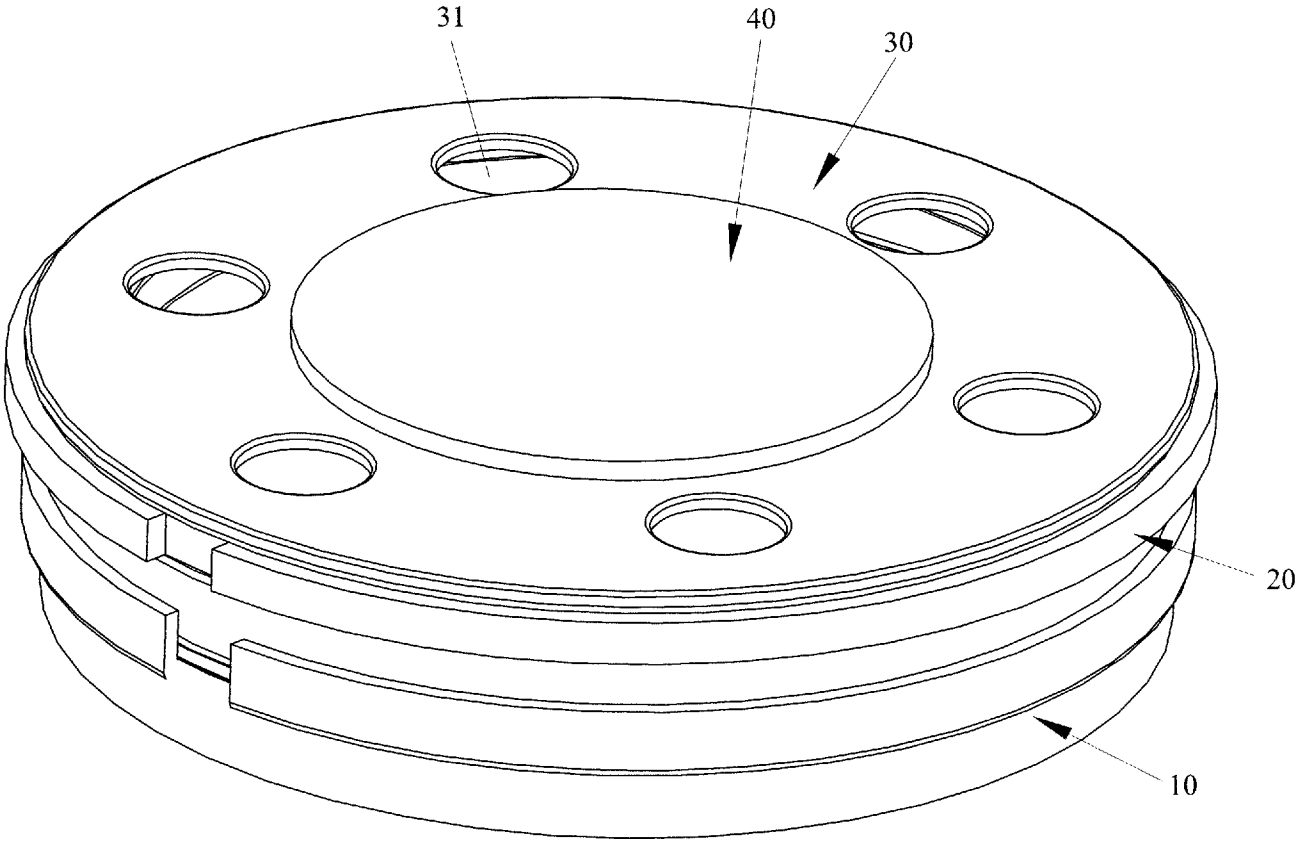
FIG. 8 is a perspective view showing a fourth preferred embodiment of the present invention in an assembled form.

Referring to FIG. 8, which illustrates a specific structure of a fourth preferred embodiment of the present invention, the structure of the instant embodiment is generally identical to the structure of the third embodiment and a difference is as follows:

In the instant embodiment, the piezoelectric ceramic plate 40 is circular in shape.

The assembling process of the instant embodiment is generally similar to the assembling process of the third embodiment and thus, no further detail regarding the assembly of the instant embodiment will be provided here.

Figure 9:
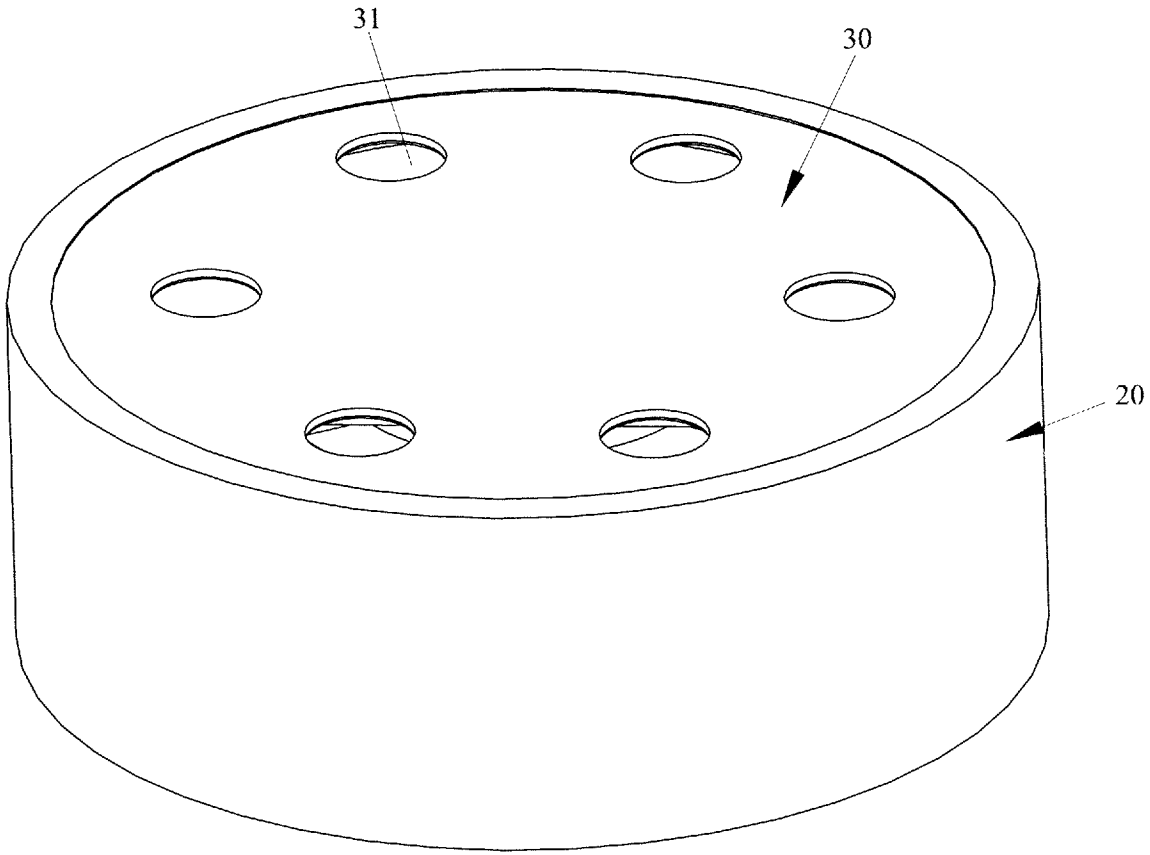
FIG. 9 is a perspective view showing a fifth preferred embodiment of the present invention in an assembled form.
Figure 10:
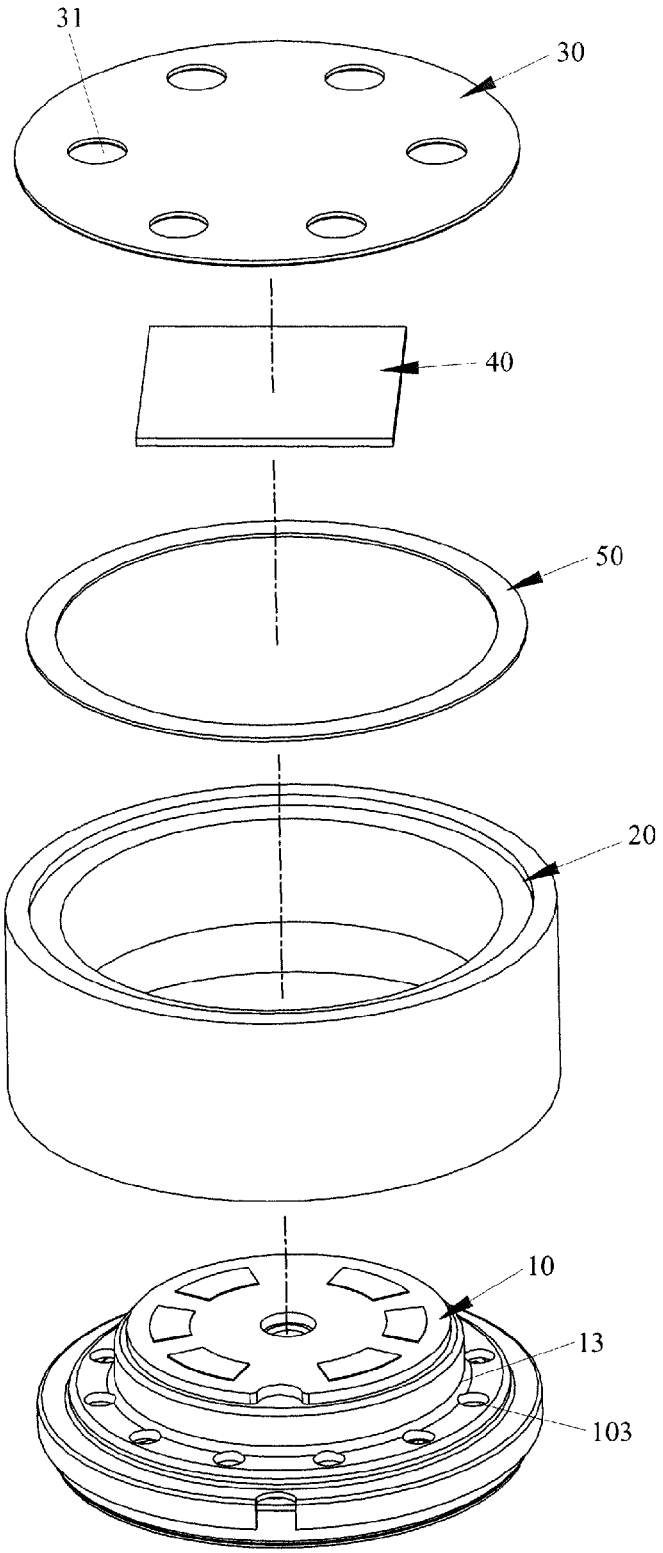
FIG. 10 is an exploded view of the fifth preferred embodiment of the present invention.
Figure 11:
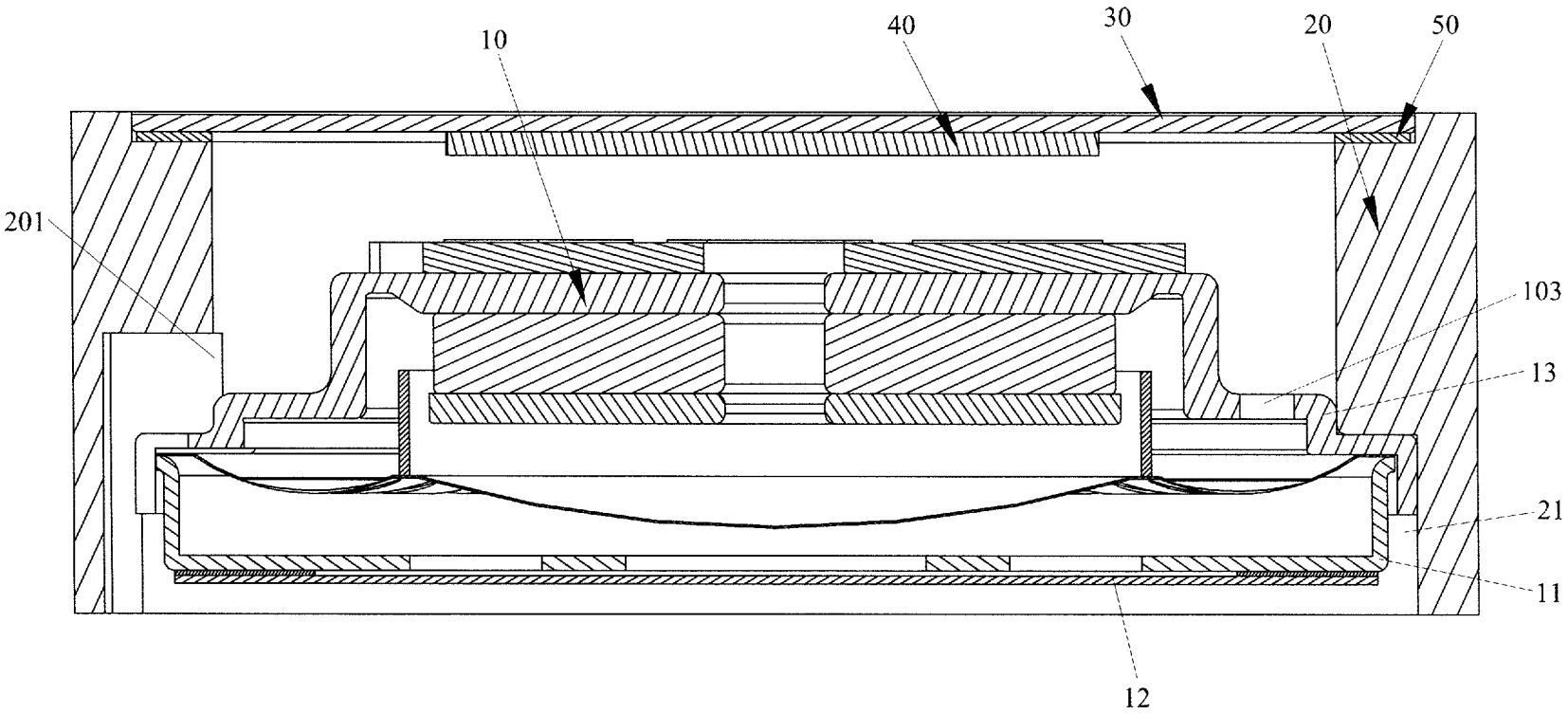
FIG. 11 is a cross-sectional view of the fifth preferred embodiment of the present invention.

Referring to FIGS. 9-11, which illustrate a specific structure of a fifth preferred embodiment of the present invention, the structure of the instant embodiment is generally identical to the structure of the first embodiment and differences are as follows:

The support frame 20 is an annular frame. The annular frame comprises a receiving compartment 21 formed in one side thereof. The annular frame is provided therein with a sound emission channel 201. The moving coil speaker 10 is received in the receiving compartment 21. The moving coil speaker 10 comprises a protection cover 11 that is arranged opposite to the vibration plate 30. The protection cover 11 has an outside surface on which a sealing board 12 is disposed. The moving coil speaker 10 comprises a frame 13 in which fourth sound emission holes 103 are formed. The sound emission channel 201 is arranged between and in communication with the fourth sound emission holes 103 and the vibration plate 30. Further, the piezoelectric ceramic plate 40 is positioned on an undersurface of the vibration plate 30.

To assemble, first, the moving coil speaker 10 is disposed in the receiving compartment 21, and then, the piezoelectric ceramic plate 40 is positioned on the undersurface of the vibration plate 30, and afterwards, the first gasket 50 and the vibration plate 30 are sequentially disposed on the support frame 20 on the same side thereof and located exactly above and covering the moving coil speaker 10.

Figure 12:
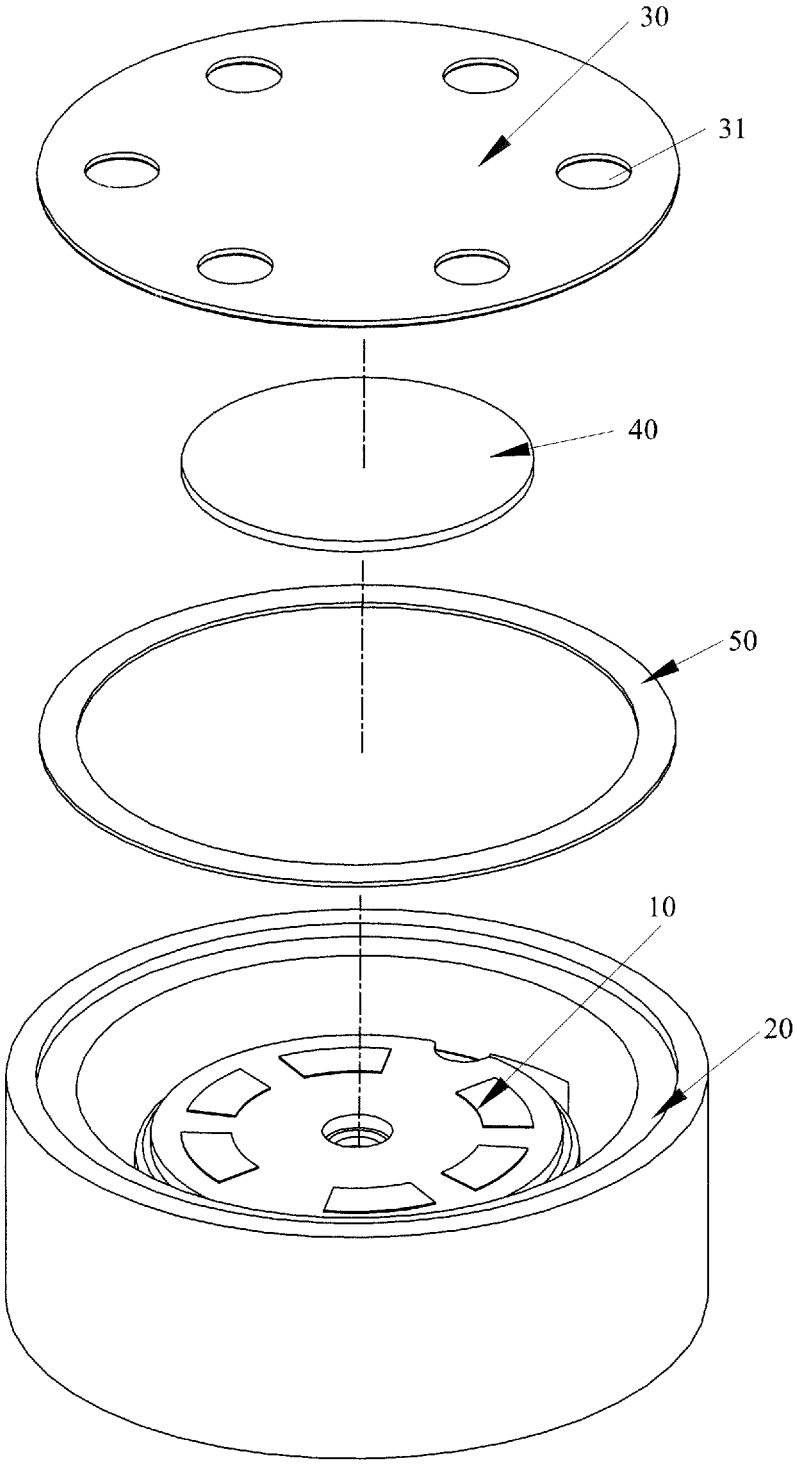
FIG. 12 is a perspective view showing a sixth preferred embodiment of the present invention in an assembled form.

Referring to FIG. 12, which illustrates a specific structure of a sixth preferred embodiment of the present invention, the structure of the instant embodiment is generally identical to the structure of the fifth embodiment and a difference is as follows:

In the instant embodiment, the piezoelectric ceramic plate 40 is circular in shape.

The assembling process of the instant embodiment is generally similar to the assembling process of the fifth embodiment and thus, no further detail regarding the assembly of the instant embodiment will be provided here.

Figure 13:
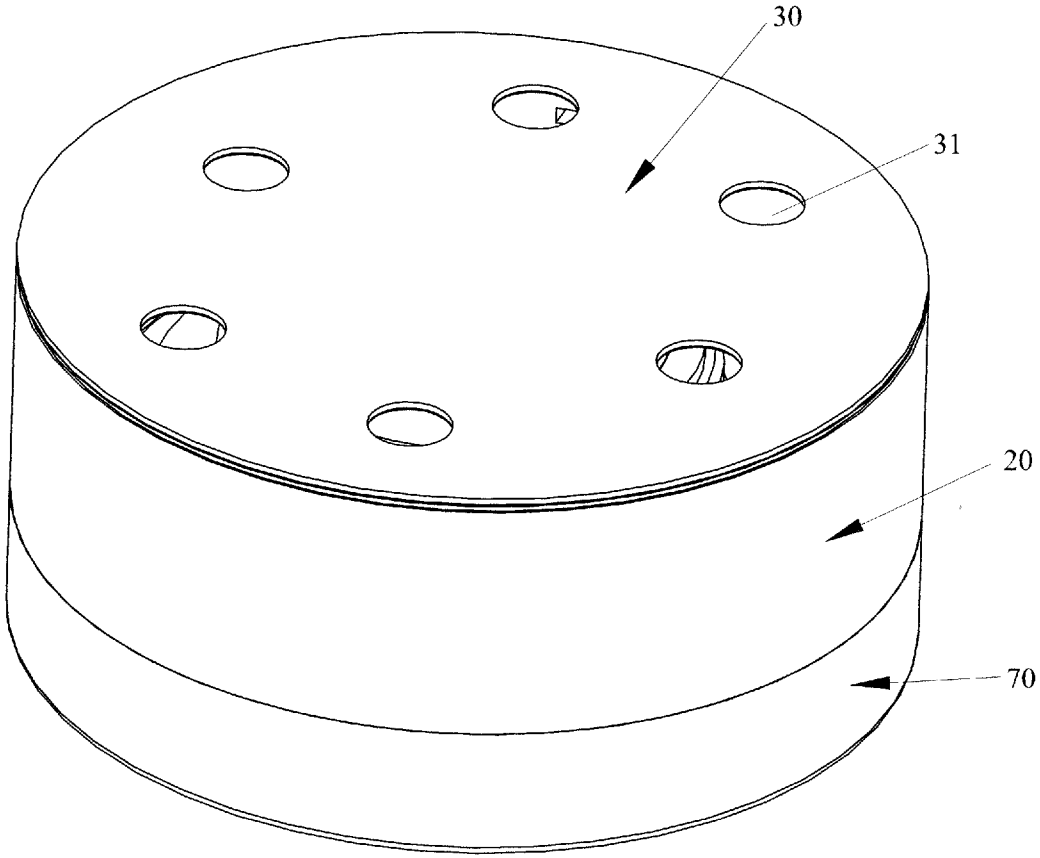
FIG. 13 is a perspective view showing a seventh preferred embodiment of the present invention in an assembled form.
Figure 14:
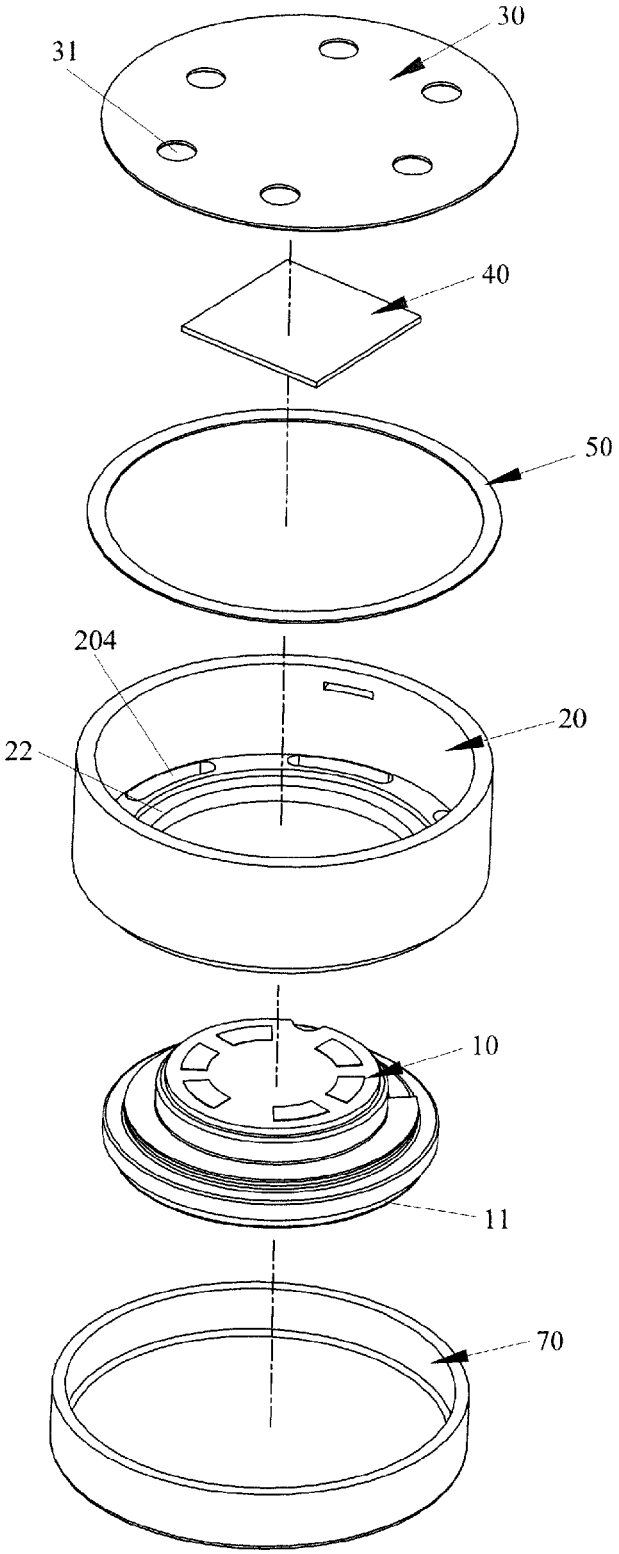
FIG. 14 is an exploded view of the seventh preferred embodiment of the present invention.
Figure 15:
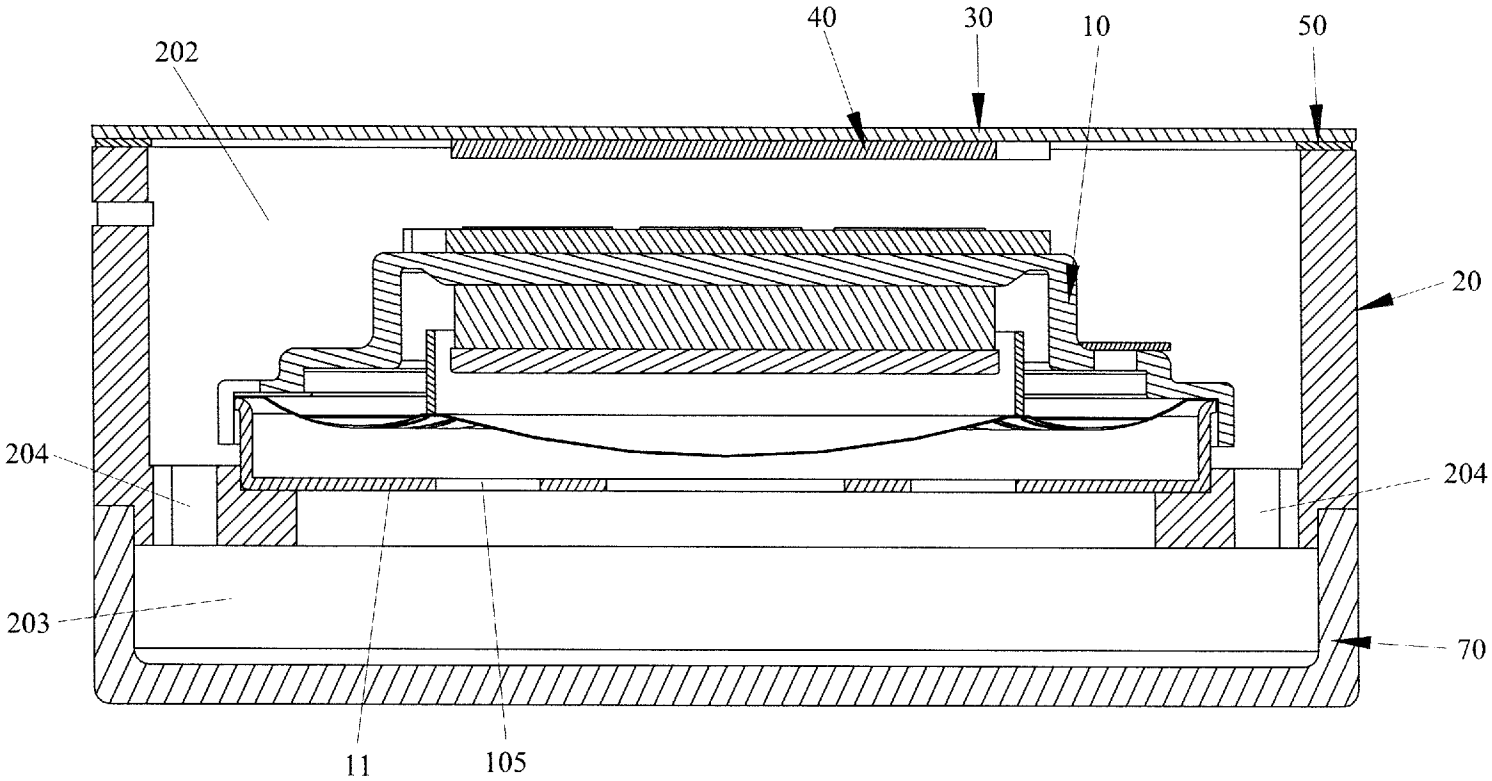
FIG. 15 is a cross-sectional view of the seventh preferred embodiment of the present invention.

Referring to FIGS. 13-15, which illustrate a specific structure of a seventh preferred embodiment of the present invention, the structure of the instant embodiment is generally identical to the structure of the first embodiment and differences are as follows:

The support frame 20 comprises a closure cap 70 arranged on a bottom thereof. The support frame 20 comprises a mounting section 22 formed therein such that one side of the mounting section 22 and the vibration plate 30 define therebetween a first audio chamber 202. An opposite side of the mounting section 22 and the closure cap 70 define therebetween a second audio chamber 203. The mounting section 22 comprises sound guide holes 204 formed therein and the sound guide holes 204 are connected between and in communication with the first audio chamber 202 and the second audio chamber 203. The moving coil speaker 10 is positioned on the mounting section 22 and located in the first audio chamber 202. The moving coil speaker 10 comprises a protection cover 11 that comprises a plurality of fifth sound emission holes 104 formed therein. The plurality of fifth sound emission holes 104 is arranged to correspond exactly to and communicate with the second audio chamber 203. Further, in the instant embodiment, the sound guide holes 204 are each of an arc-shaped through slot structure. And, the sound guide holes 204 are provided in plurality. The plurality of sound guide holes 204 is distributed, in a uniform manner, around a circumference of the moving coil speaker 10.

To assemble, first, the moving coil speaker 10 is disposed in the first audio chamber 202 and is mounted on the mounting section 22. Afterwards, the closure cap 70 is disposed on the bottom of the support frame 20. And then, the piezoelectric ceramic plate 40 is positioned on an undersurface of the vibration plate 30 and afterwards, the first gasket 50 and the vibration plate 30 are sequentially disposed on the support frame 20 on the same side thereof and located exactly above and covering the moving coil speaker 10.

Figure 16:
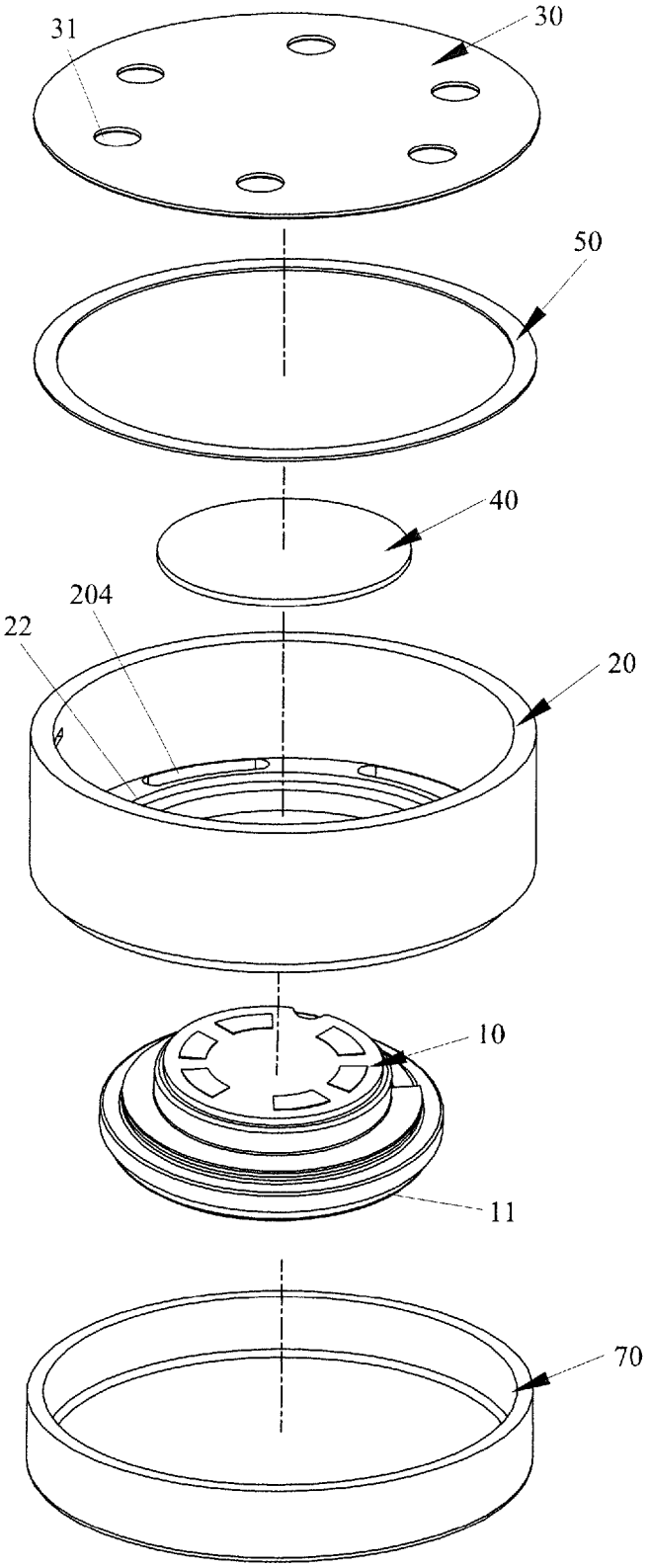
FIG. 16 is a perspective view showing an eighth preferred embodiment of the present invention in an assembled form.

Referring to FIG. 16, which illustrates a specific structure of an eighth preferred embodiment of the present invention, the structure of the instant embodiment is generally identical to the structure of the seventh embodiment and a difference is as follows:

In the instant embodiment, the piezoelectric ceramic plate 40 is circular in shape.

The assembling process of the instant embodiment is generally similar to the assembling process of the fifth embodiment and thus, no further detail regarding the assembly of the instant embodiment will be provided here.

Figure 17:
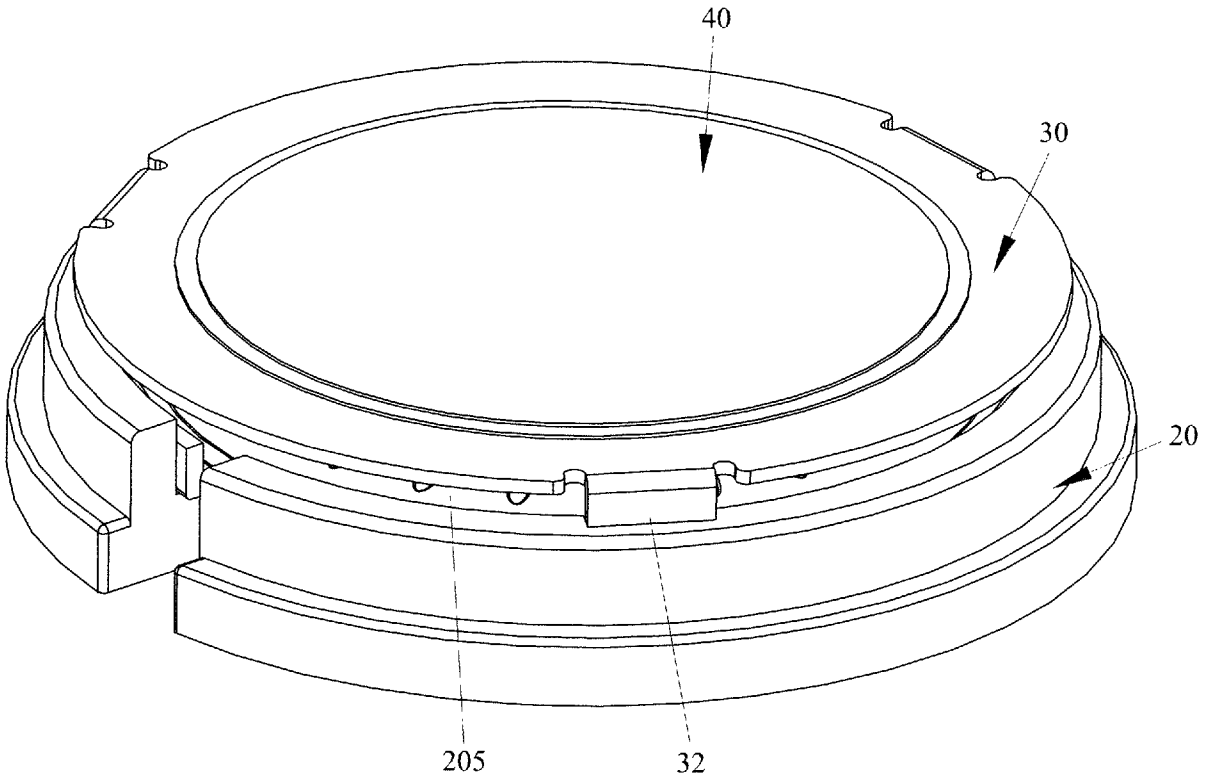
FIG. 17 is a perspective view showing a ninth preferred embodiment of the present invention in an assembled form.
Figure 18:
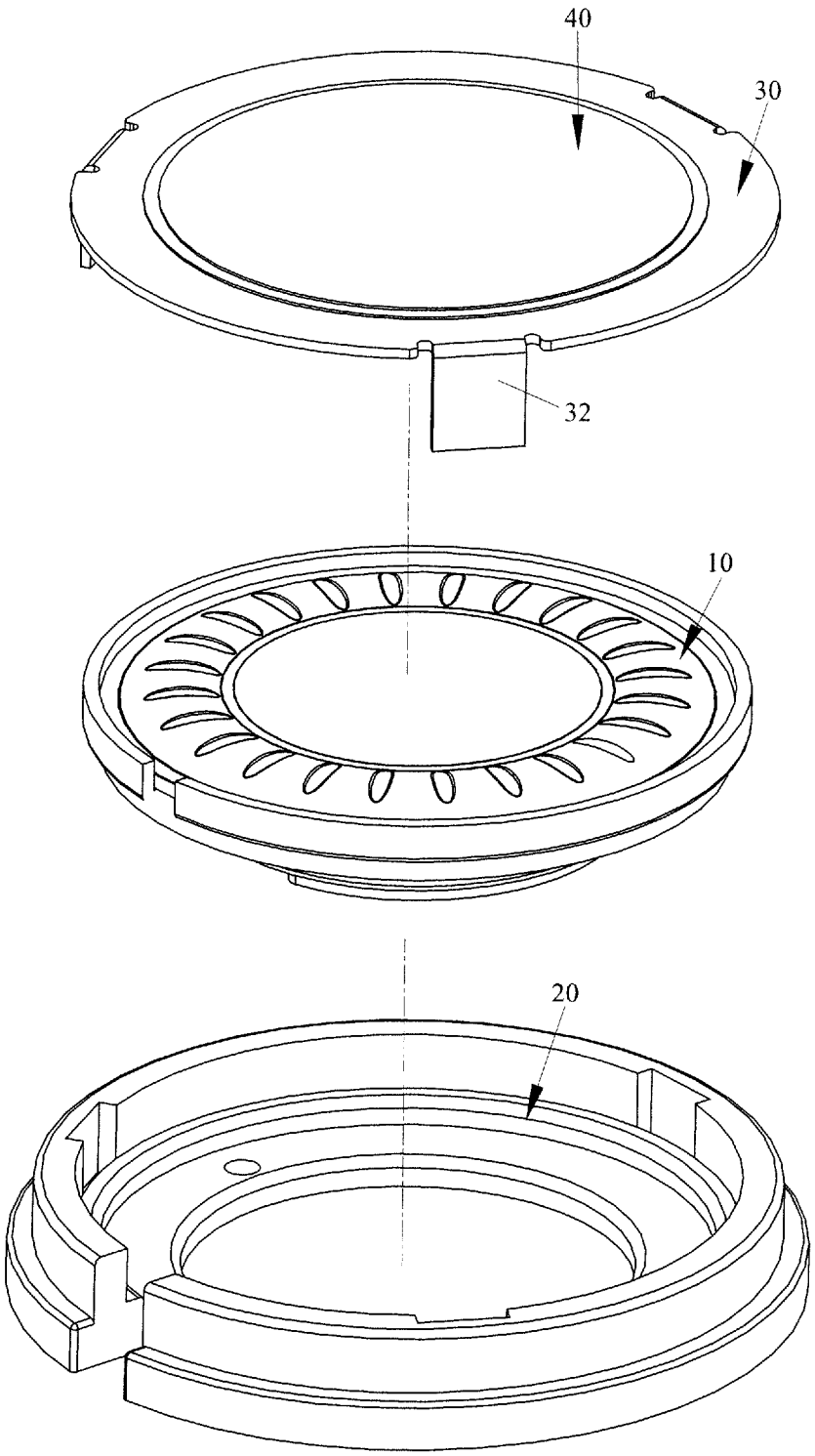
FIG. 18 is an exploded view of the ninth preferred embodiment of the present invention.
Figure 19:
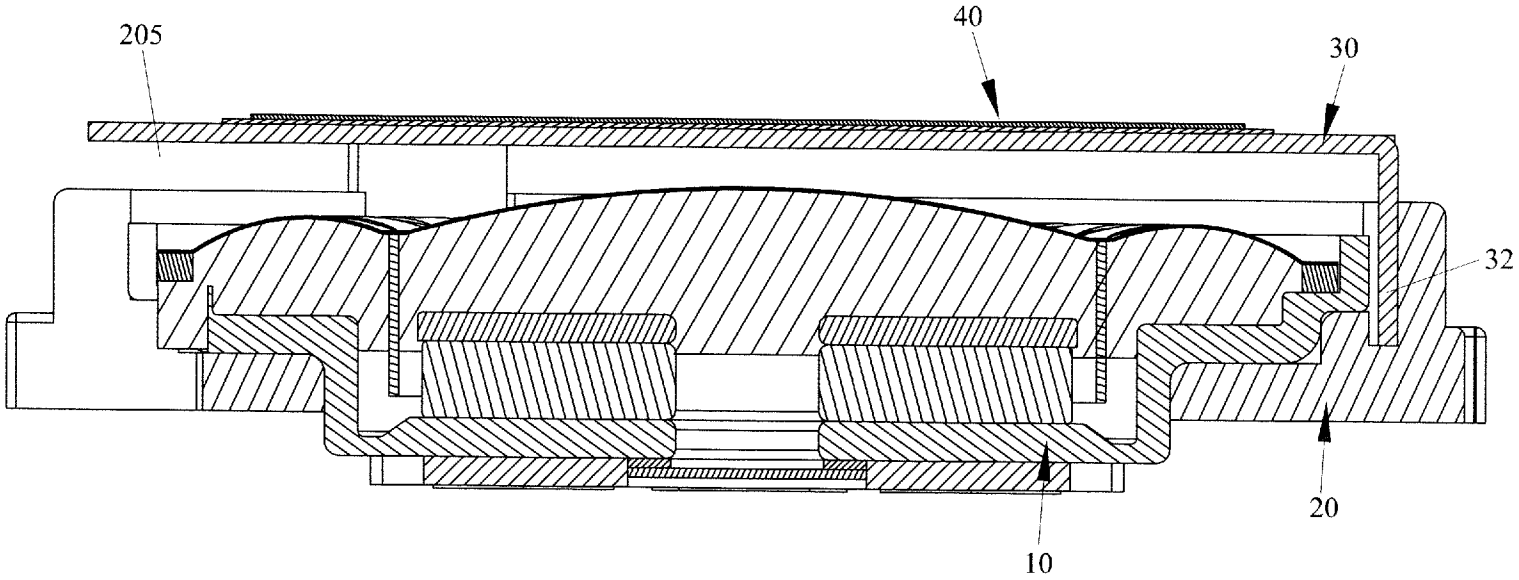
FIG. 19 is a cross-sectional view of the ninth preferred embodiment of the present invention.

Referring to FIGS. 17-19, which illustrate a specific structure of a ninth preferred embodiment of the present invention, the structure of the instant embodiment is generally identical to the structure of the second embodiment and differences are as follows:

In the instant embodiment, the vibration plate 30 is arranged on the support frame 20 in a suspended manner. The vibration plate 30 and the support frame 20 define therebetween a sound emission gap 205. Further, the vibration plate 30 has a circumference from which support legs 32 extend. The support legs 32 are inserted into and thus fixed on the support frame 20.

The assembling process of the instant embodiment is generally similar to the assembling process of the second embodiment and thus, no further detail regarding the assembly of the instant embodiment will be provided here.

Figure 20:
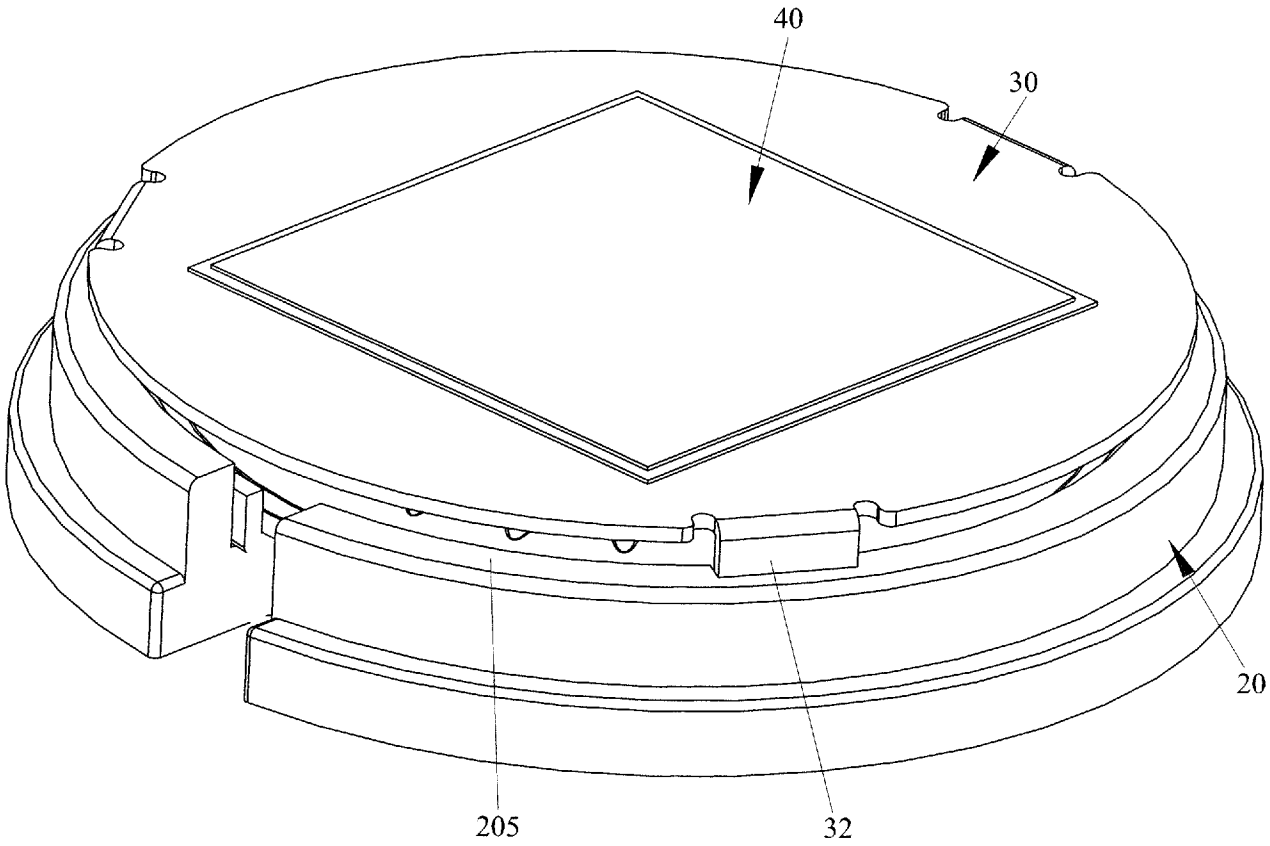
FIG. 20 is a perspective view showing a tenth preferred embodiment of the present invention in an assembled form.

Referring to FIG. 20, which illustrates a specific structure of a tenth preferred embodiment of the present invention, the structure of the instant embodiment is generally identical to the structure of the ninth embodiment and a difference is as follows:

In the instant embodiment, the piezoelectric ceramic plate 40 is square or rectangular in shape.

The assembling process of the instant embodiment is generally similar to the assembling process of the ninth embodiment and thus, no further detail regarding the assembly of the instant embodiment will be provided here.

Figure 21:
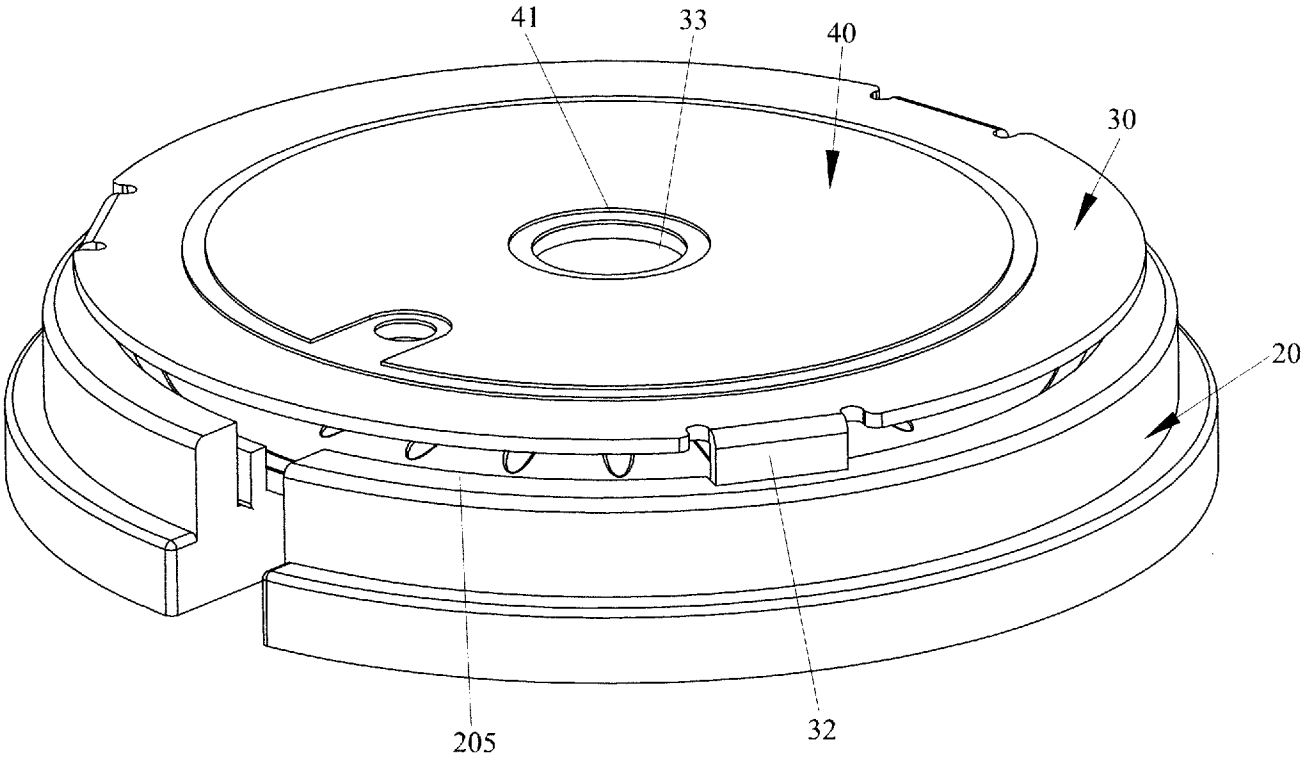
FIG. 21 is a perspective view showing an eleventh preferred embodiment of the present invention in an assembled form.
Figure 22:
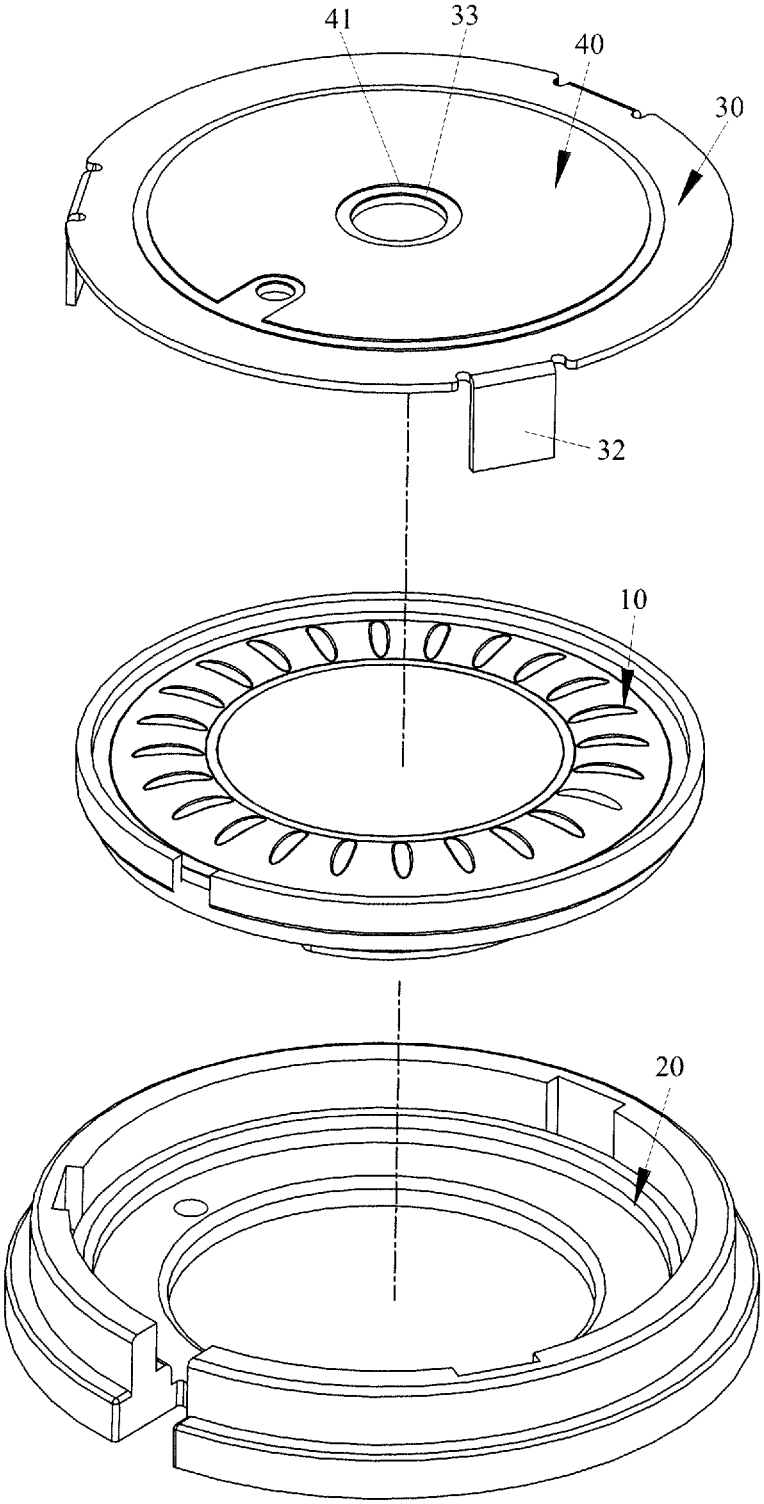
FIG. 22 is an exploded view of the eleventh preferred embodiment of the present invention.
Figure 23:
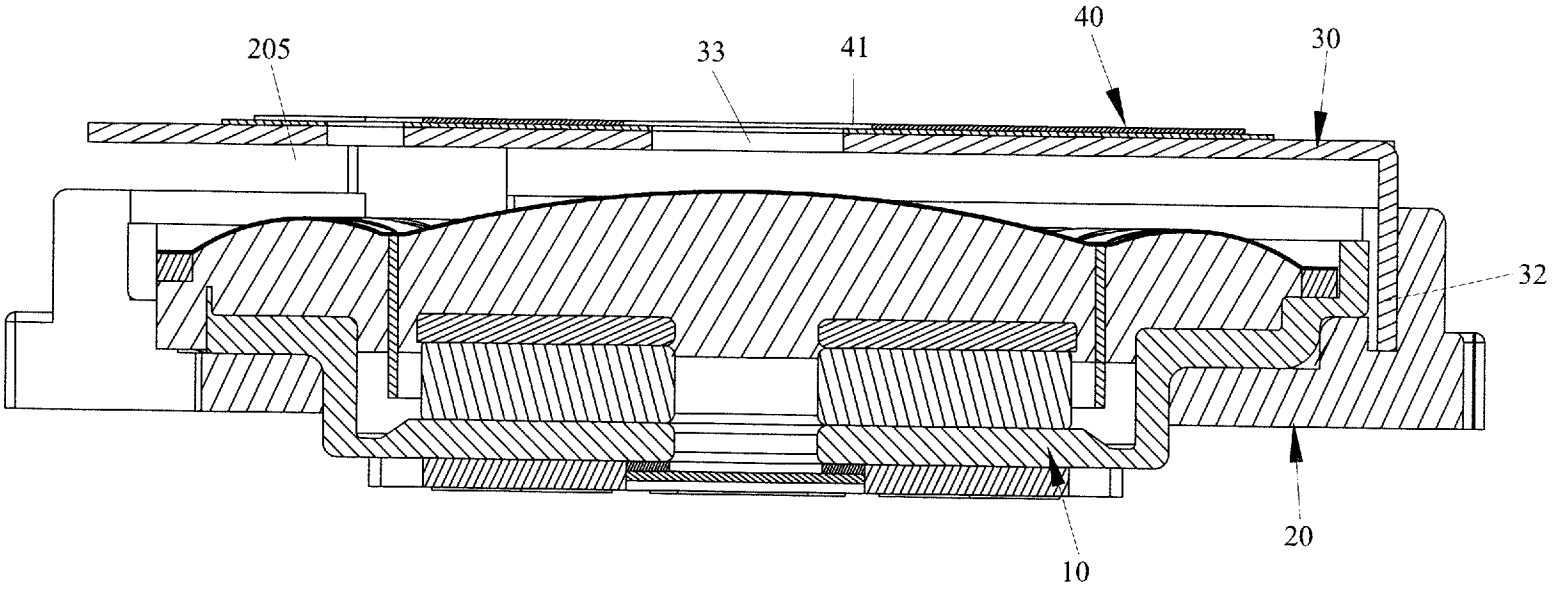
FIG. 23 is a cross-sectional view of the eleventh preferred embodiment of the present invention.

Referring to FIGS. 21-23, which illustrate a specific structure of an eleventh preferred embodiment of the present invention, the structure of the instant embodiment is generally identical to the structure of the ninth embodiment and differences are as follows:

In the instant embodiment, the vibration plate 30 comprises a sixth sound emission hole 33 formed therein. The piezoelectric ceramic plate 40 comprises a seventh sound emission hole 41 formed therein. The seventh sound emission hole 41 and the sixth sound emission hole 33 vertically correspond to each other and are in communication with each other. The seventh sound emission hole 41 is provided in singular form and is located in a central location of the piezoelectric ceramic plate 40.

The assembling process of the instant embodiment is generally similar to the assembling process of the ninth embodiment and thus, no further detail regarding the assembly of the instant embodiment will be provided here.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

We claim:

1. A high sound quality piezoelectric speaker, comprising a moving coil speaker, a support frame, a vibration plate, and a piezoelectric ceramic plate, wherein the support frame is arranged on the moving coil speaker; the vibration plate is arranged on the support frame; the moving coil speaker has a sound emission direction in communication with the vibration plate; and the piezoelectric ceramic plate is arranged on the vibration plate, wherein the support frame is an annular frame, the annular frame comprising a receiving compartment formed in one side thereof, the annular frame being provided therein with a sound emission channel, the moving coil speaker being received in the receiving compartment, the moving coil speaker comprising a protection cover that is arranged opposite to the vibration plate, the protection cover having an outside surface on which a sealing board is disposed, the moving coil speaker comprising a frame in which fourth sound emission holes are formed, the sound emission channel being arranged between and in communication with the fourth sound emission holes and the vibration plate.

2. The high sound quality speaker according to claim 1, wherein the vibration plate and the support frame comprises a first gasket interposed therebetween, the vibration plate comprising a plurality of first sound emission holes formed therein, the plurality of first sound emission holes being arranged to distribute around a periphery of the piezoelectric ceramic plate.

3. The high sound quality speaker according to claim 1, wherein the piezoelectric ceramic plate is circular or square or rectangular in shape and the piezoelectric ceramic plate is positioned on a top surface or an undersurface of the vibration plate.

4. The high sound quality speaker according to claim 1, wherein the vibration plate is mounted on the support frame in a suspended manner and the vibration plate and the support frame define therebetween a sound emission gap.

5. The high sound quality speaker according to claim 4, wherein the vibration plate has a circumference from which a support leg extends, the support leg being inserted into and fixed on the support frame.

6. The high sound quality speaker according to claim 1, wherein the vibration plate comprises a sixth sound emission hole formed therein, the piezoelectric ceramic plate comprising a seventh sound emission hole formed therein, the seventh sound emission hole and the sixth sound emission holes being arranged to vertically correspond each other and in communication with each other.

7. The high sound quality speaker according to claim 6, wherein the seventh sound emission hole is arranged in a singular form and is arranged at a center of the piezoelectric ceramic plate.

8. A high sound quality piezoelectric speaker, comprising a moving coil speaker, a support frame, a vibration plate, and a piezoelectric ceramic plate, wherein the support frame is arranged on the moving coil speaker; the vibration plate is arranged on the support frame; the moving coil speaker has a sound emission direction in communication with the vibration plate; and the piezoelectric ceramic plate is arranged on the vibration plate, wherein the support frame has a bottom on which a closure cap is disposed, the support frame comprising a mounting section formed therein such that one side of the mounting section and the vibration plate define therebetween a first audio chamber, an opposite side of the mounting section and the closure cap defining therebetween a second audio chamber, the mounting section comprising sound guide holes formed therein such that the sound guide holes are connected between and in communication with the first audio chamber and the second audio chamber, the moving coil speaker being mounted on the mounting section and located in the first audio chamber, the moving coil speaker comprising a protection cover that comprises a plurality of fifth sound emission holes formed therein, the plurality of fifth sound emission holes being arranged to correspond exactly to and communicate with the second audio chamber.

* * * * *